US008529076B2

(12) United States Patent
Chang

(10) Patent No.: US 8,529,076 B2
(45) Date of Patent: Sep. 10, 2013

(54) LED LAMP

(75) Inventor: Kuo-Cheng Chang, Miao-Li (TW)

(73) Assignee: Foxsemicon Integrated Technology, Inc., Chu-Nan, Miao-Li, Hsien (TW)

( * ) Notice: Subject to any disclaimer, the term of this patent is extended or adjusted under 35 U.S.C. 154(b) by 180 days.

(21) Appl. No.: 13/277,154

(22) Filed: Oct. 19, 2011

(65) Prior Publication Data

US 2012/0140441 A1 Jun. 7, 2012

(30) Foreign Application Priority Data

Dec. 6, 2010 (TW) ..... 99142278

(51) Int. Cl.
*F21V 21/30* (2006.01)

(52) U.S. Cl.
USPC ..... 362/35; 362/233; 362/249.03; 362/249.1; 362/269; 362/285; 362/427; 362/800

(58) Field of Classification Search
USPC . 362/35, 232–233, 238–238, 249.02–249.03, 362/249.1, 269, 285, 372, 418, 427, 800
See application file for complete search history.

(56) References Cited

U.S. PATENT DOCUMENTS 8,029,159 B2 * 10/2011 Chen ..... 362/249.1

* cited by examiner

*Primary Examiner* — Jason Moon Han
(74) *Attorney, Agent, or Firm* — Altis Law Group, Inc.

(57) ABSTRACT

An exemplary LED lamp includes a socket, an LED module, a signal receiver, and a signal emitter. The LED module includes a micro-computer processor, a power module and an adjuster electrically connecting with the micro-computer processor and the power module. The LED module is mounted on the adjuster. The signal receiver is mounted on the LED module. The signal receiver receives a signal emitted from the signal emitter and transmits the signal to the micro-computer processor. The micro-computer processor dictates the power module to drive the adjuster to rotate. The LED module rotates following the rotation of the adjuster to change an illumination angle of the LED module.

18 Claims, 3 Drawing Sheets

LED LAMP

BACKGROUND

1. Technical Field

The present disclosure relates to LED lamps, and particularly to an LED lamp being capable of adjusting illumination angles thereof.

2. Description of Related Art

LEDs have many advantages, such as high luminosity, low operational voltage, low power consumption, faster switching, long-term reliability, environmental friendliness for not having to use mercury (Hg), and high impact resistance, which have promoted LEDs to be widely used as light sources.

A conventional LED lamp includes an LED module mounted on a socket. Generally, the LED module is immovable relative to the socket. Thus, an illumination angle of the LED lamp is fixed and can not be adjusted easily to meet varied requirements of illumination. As such, the usage of the LED lamp is limited.

Accordingly, it is desirable to provide an LED lamp which can overcome the described limitations.

DETAILED DESCRIPTION

Figure 1:
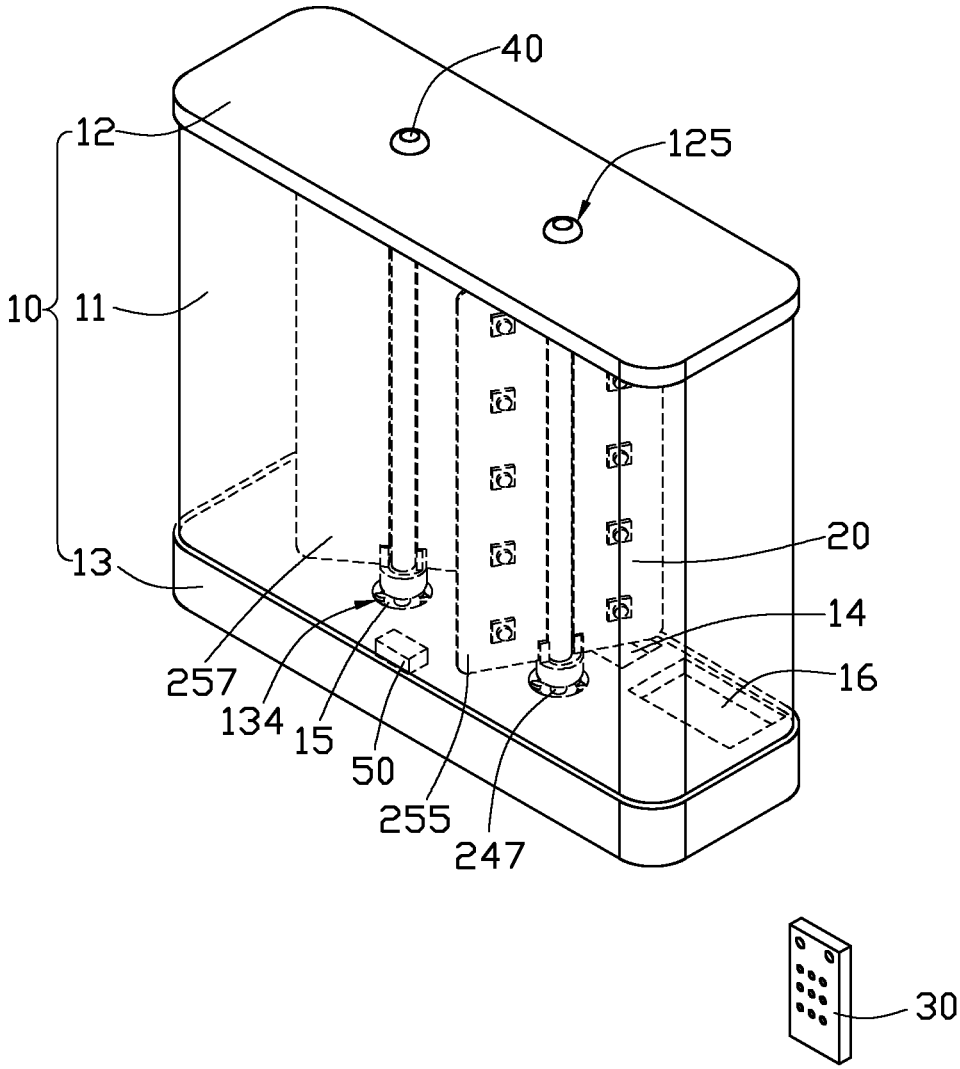
FIG. 1 is an assembled, perspective view of an LED lamp according to an embodiment of the present disclosure.

Referring to FIG. 1, an LED lamp of the present disclosure is shown. The LED lamp includes a container 10 and a plurality of LED modules 20 received in the container 10.

The container 10 includes a cover 12, a socket 13 below the cover 12 and a shell 11 between the cover 12 and the socket 13. The shell 11 allows light to radiate therethrough to illuminate an environment. Preferably, the shell 11 is transparent and made of plastic or glass.

Figure 2:
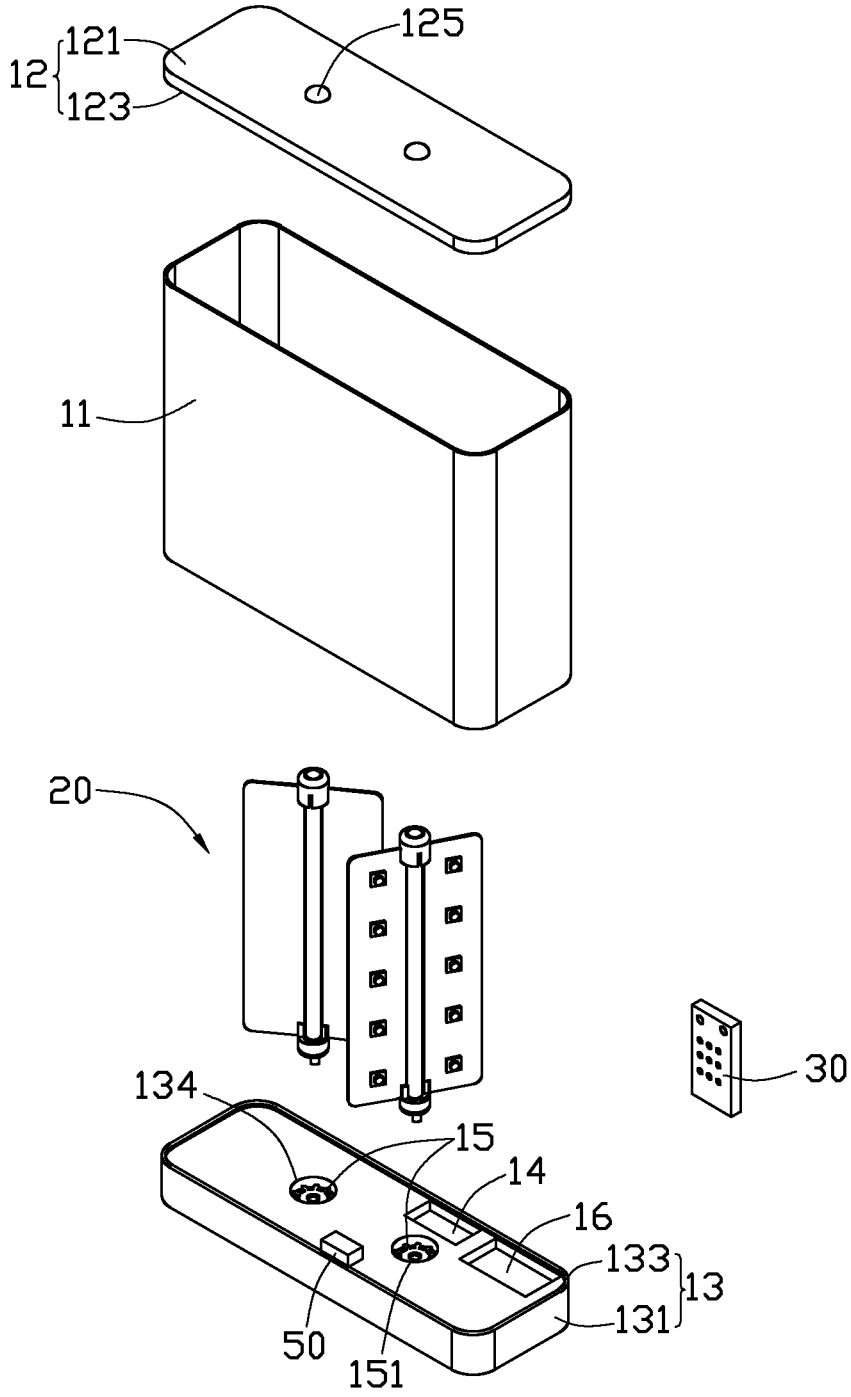
FIG. 2 is an exploded view of the LED lamp of FIG. 1.

Referring also to FIG. 2, the cover 12 includes a rectangular top plate 121 and four sidewalls 123 perpendicularly extending from edges of the top plate 121 towards the socket 13. Two through holes 125 are defined in the top plate 121 in order to fix the LED modules 20 in the container 10. The LED modules 20 have a number of two.

The socket 13 includes a rectangular engaging portion 131 and four sidewalls 133 perpendicularly extending from edges of the engaging portion 131 towards the cover 12. A central portion of the engaging portion 131 defines two recesses 134 aligned with the two through holes 125 in the top plate 12 of the cover 10. Two adjusters 15 are respectively received in the recesses 134 for adjusting illumination angles of the LED modules 20. In this embodiment, each adjuster 15 is a gear and rotatable relative to a corresponding recess 134 of the socket 13. A through hole 151 is defined in a middle of the adjuster 15 for fixedly receiving a bottom end of a corresponding LED module 20 therein.

A power module 14 and a micro-computer processor 16 are received in the engaging portion 131. A sensor 50 is mounted on a top surface of the engaging portion 131 to detect illumination and positions of the LED modules 20. The LED modules 20, the power module 14, the micro-computer processor 16, and the sensor 50 electrically connect to each other.

The shell 11 is a hollow cube and opposite ends thereof are respectively enclosed by the cover 12 and the socket 13.

Figure 3:
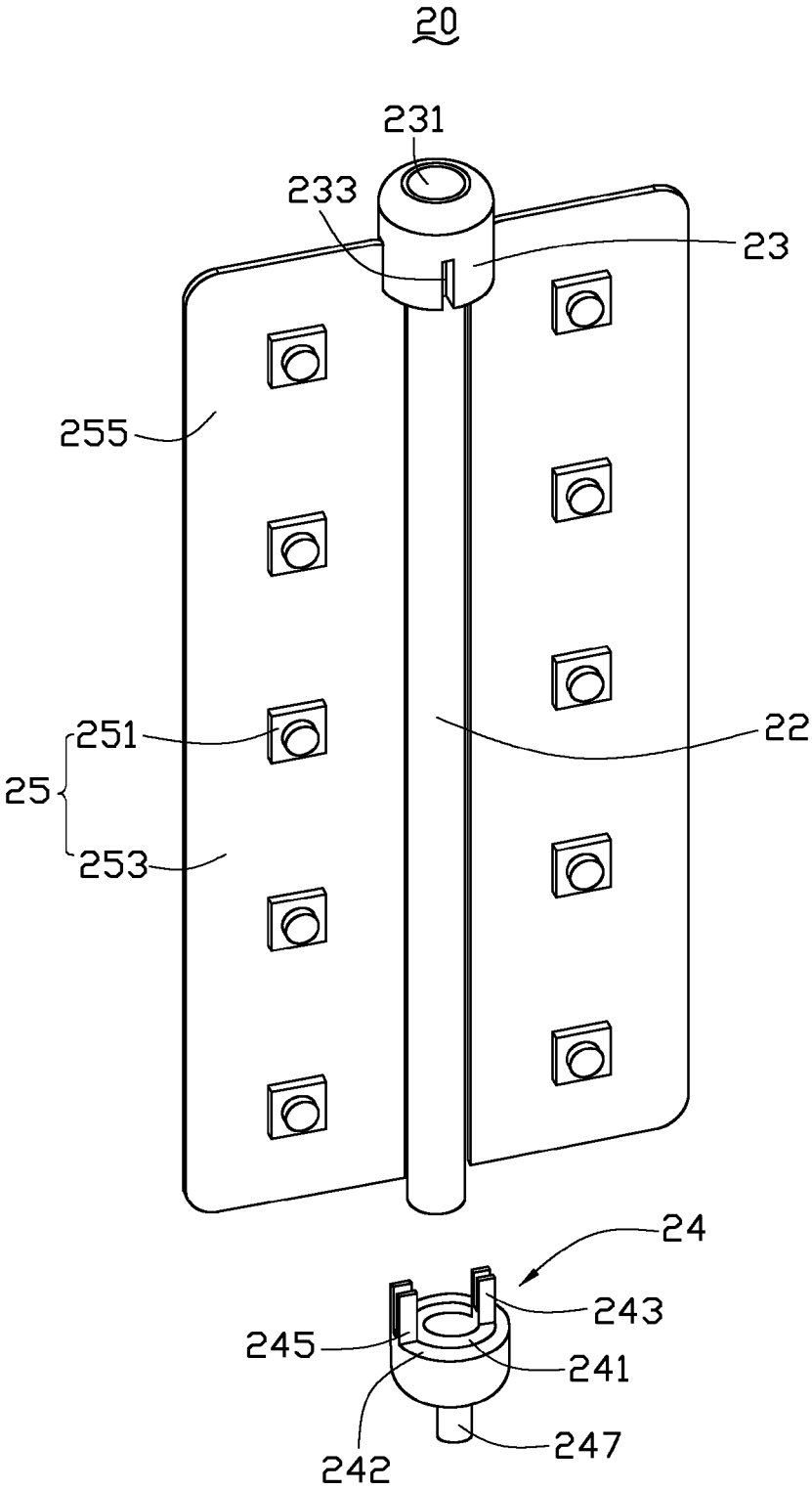
FIG. 3 is an enlarged, isometric view of an LED module of the LED lamp of FIG. 2.

Referring also to FIG. 3, each LED module 20 includes a shaft 22, a first connector 23 and a second connector 24 respectively engaging with opposite top and bottom ends of the shaft 22, and two lighting members 25 located at opposite lateral sides of the shaft 22 and connecting with the first and second connectors 23, 24. The shaft 22 is hollow and receives wires (not shown) therein, which are electrically connected with the two lighting members 25. The first and second connectors 23, 24 are connected with the shaft 22.

The first connector 23 is a hollow cylinder. A top end of the first connector 23 defines a recess 231 at a middle thereof. A signal receiver 40 (as shown in FIG. 1) is received in the recess 231. A plurality of slits 233 is defined at a bottom end of the first connector 23. The slits 233 are spaced from each other with a predetermined distance therebetween. An inner diameter of the first connector 23 is larger than an outer diameter of the shaft 22.

The second connector 24 includes an inner ring 241 and an outer ring 242 surrounding the inner ring 241. The inner ring 241 and the outer ring 242 are hollow cylinders and rotatablely engage with each other. An outer diameter of the outer ring 242 is equal to or slightly smaller than an inner diameter of the recess 134 of the socket 13. A pole 247 protrudes out from a bottom end of the outer ring 242. A diameter of the pole 247 is equal to an inner diameter of the through hole 151 of the adjuster 15. An inner diameter of the inner ring 241 is equal to or slightly larger than the outer diameter of the shaft 22. An inner clip 243 is formed on a top end of the inner ring 242. An outer clip 245 is formed on a top end of the outer ring 242. The inner clip 243 or the outer clip 245 each includes two spaced claws each having a form of a tab.

Each lighting member 25 includes an elongated sheet 253 and a plurality of LEDs 251 mounted on one side of the sheet 253. A printed circuit layer 255 is formed on the sheet 253 and electrically connects with the LEDs 251. The other side of the sheet 253 is coated with a layer of lighting-reflecting material 257 to reflect light emitted from the LEDs 253. The sheet 253 is shorter than the shaft 22.

When the LED module 20 is assembled, a top end of the shaft 22 is inserted in the first connector 23. The two lighting members 25 are arranged on the lateral sides of the shaft 22. Inner sides of top ends of the sheets 253 are respectively inserted in two corresponding slits 233 of the first connector 23 to define a predetermined angle between the sheets 253. The top ends of the sheets 253 abut against the first connector 23. The inner ring 241 is rotatable relative to the outer ring 242, whereby a relative position between the inner clip 243 and the outer clip 245 is adjustable. Inner sides of bottom ends of the sheets 253 are respectively inserted in the inner clip 243 and the outer clip 245 and abut against the inner ring 241 and the outer ring 242. A bottom end of the shaft 22 is inserted in the inner ring 241. In this state, the LED module 20 is assembled completely. Alternatively, the LED module 20 can have two second connectors 24 at the opposite top and bottom ends, whereby the first connector 23 is replaced by one of the second connectors 24.

Referring to FIGS. 1-2 again, when the LED lamp is assembled, the assembled LED modules 20 are mounted on the socket 13. The second connecters 24 are respectively received in the recesses 134 of the socket 13 and the poles 247 of the second connectors 24 are respectively inserted in the through holes 151 of the adjusters 15 and firmly engage with the adjusters 15. The shell 11 surrounds the LED modules 20 and the bottom end thereof engages with the socket 13. The cover 12 covers the top end of the shell 11. The first connectors 23 are respectively inserted in the through holes 125 of the cover 12 and the top ends thereof are located at an outside of the top plate 121 of the cover 12. The two signal receivers 40 are respectively received in the recesses 231 of the first connectors 23. In this state, the LED lamp is assembled completely.

When the illumination angle of the LED lamp is needed to be adjusted, a signal emitter 30 is used. The signal receivers 40 mounted on the first connectors 23 receive signals from the signal emitter 30, and transmit the signals to the micro-computer processor 16. The sensor 50 detects the illumination and the positions of the LED modules 20, simultaneously, and emits a corresponding signal to the micro-computer processor 16. The micro-computer processor 16 dictates the power module 14 to drive the adjusters 15 to rotate relative to the socket 13 according to the signals received from the receivers 40 and the sensor 50 by the micro-computer processor 16. The LED modules 20 rotate with the poles 247, following the rotation of the adjusters 15 until the LED modules 20 are located at the predetermined positions to obtain predetermined illumination.

It is to be understood, however, that even though numerous characteristics and advantages of the embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp comprising:

a socket comprising a micro-computer processor, a power module and an adjuster electrically connecting with the micro-computer processor and the power module;

an LED module mounted on the adjuster;

a signal receiver mounted on the LED module; and a signal emitter;

wherein the signal receiver receives a signal from the signal emitter and transmits the signal to the micro-computer processor, the micro-computer processor dictates the power module to drive the adjuster to rotate, and the LED module rotates following the rotation of the adjuster to change an illumination angle of the LED module;

wherein a sensor is mounted on the socket, the sensor detecting illumination and the illumination angle of the LED module and emitting a signal corresponding to the illumination and the illumination angle to the micro-computer processor.

2. The LED lamp of claim 1, wherein the LED module includes a pole protruding therefrom, a through hole is defined in the adjuster, the pole inserts in the through hole and firmly engages with the adjuster.

3. The LED lamp of claim 2, wherein the LED module comprises a connector, two sheets and a plurality of LEDs mounted on a side of each of the sheets, the sheets are mounted on the connector, and the pole protrudes from the connector.

4. The LED lamp of claim 3, wherein the connector comprises an inner ring and an outer ring rotatably engaging with the inner ring, and the two sheets are respectively mounted on the inner ring and the outer ring.

5. The LED lamp of claim 4, wherein two clips are respectively formed on the inner ring and the outer ring, one of the two clips clasping one end of a corresponding one of the two sheets.

6. The LED lamp of claim 4, wherein the LED module further comprise another connector above the connector, the another connector engages with the other end of each of the sheets, and the receiver is mounted on a top end of the another connector.

7. The LED lamp of claim 6, wherein the another connector defines a plurality of slits, and the sheets selectively insert two corresponding slits of the another connector.

8. The LED lamp of claim 6, wherein the LED module further comprises a shaft located between the two sheets, and opposite ends of the shaft insert in the another connector and the inner ring of the connector.

9. The LED lamp of claim 3, wherein another side of each of the sheets opposite to that the LEDs being located is coated with lighting-reflecting material.

10. The LED lamp of claim 1, wherein the adjuster is a gear which is rotatable relative to the socket.

11. The LED lamp of claim 1, wherein a hollow shell surrounds the LED module therein, and an end of the hollow shell is mounted on the socket.

12. The LED lamp of claim 11, wherein a cover covers another end of the shell and the LED module is located between the cover and the socket.

13. The LED lamp of claim 11, wherein the shell is transparent.

14. An LED lamp comprising:

a socket comprising a micro-computer processor, a power module and an adjuster electrically connecting with the micro-computer processor and the power module;

an LED module comprising a connector, two sheets and a plurality of LEDs mounted on a side of each of the sheets, the connector comprising an inner ring and an outer ring rotatably engaging with the inner ring, ends of the sheets being respectively mounted on the inner ring and the outer ring of the connector, and the connector being mounted on the adjuster;

a signal receiver mounted on the LED module; and a signal emitter;

wherein the signal receiver receives a signal emitted from the signal emitter and transmits the signal to the micro-computer processor, the micro-computer processor dictates the power module to drive the adjuster to rotate, and the LED module rotates following the rotation of the adjuster to change an illumination angle of the LED module;

wherein a sensor is mounted on the socket, the sensor detecting illumination and the illumination angle of the LED module and emitting a signal corresponding to the illumination and the illumination angle to the micro-computer processor.

15. The LED lamp of claim 14, wherein the LED module comprises another connector, the another connector engages with other ends of the sheets, and the receiver is mounted on a top end of the another connector.

16. The LED lamp of claim 15, wherein the another connector defines a plurality of slits, and the sheets selectively insert two corresponding slits of the another connector.

17. The LED lamp of claim 14, wherein a recess is defined in the socket, the adjuster is received in the recess, and the outer ring of the connector is inserted in the recess.

18. The LED lamp of claim 17, wherein the adjuster is a gear and defines a through hole at a middle thereof, a pole protrudes from the outer ring and is inserted in the through hole of the gear, and the pole firmly engages with the gear.

* * * * *